US005459813A

United States Patent [19]

Klayman

[11] Patent Number: 5,459,813

[45] Date of Patent: Oct. 17, 1995

[54] PUBLIC ADDRESS INTELLIGIBILITY SYSTEM

[75] Inventor: Arnold L. Klayman, Huntington Beach, Calif.

[73] Assignee: R.G.A. & Associates, Ltd, Seattle, Wash.

[21] Appl. No.: 82,128

[22] Filed: Jun. 23, 1993

Related U.S. Application Data

[63] Continuation of Ser. No. 676,037, Mar. 27, 1991, abandoned.

[51] Int. Cl.[6] ..... G10L 3/02; G10L 9/00

[52] U.S. Cl. ..... 395/2.18; 381/29; 381/82; 395/2.14; 395/2.17; 395/2.1

[58] Field of Search ..... 381/51, 76, 90, 381/46, 42, 44, 47, 48, 68, 82, 96; 395/2, 2.1, 2.14–2.18, 2.67, 2.77, 2.87; 379/89; 370/88

[56] References Cited

U.S. PATENT DOCUMENTS

| | | | |
|---|---|---|---|
| 4,166,926 | 9/1979 | Sieler | 381/76 |
| 4,186,280 | 1/1980 | Geiseler | 179/100.1 |
| 4,441,202 | 4/1984 | Tong et al. | 381/68 |
| 4,506,379 | 3/1985 | Komatsu | 381/46 |
| 4,542,524 | 9/1985 | Laine | 395/2.78 |
| 4,641,343 | 2/1987 | Holland et al. | 381/48 |
| 4,661,981 | 4/1987 | Henrickson et al. | 395/2.33 |
| 4,696,040 | 9/1987 | Doddington et al. | 381/46 |
| 4,703,505 | 10/1987 | Seiler et al. | 381/51 |
| 4,707,858 | 11/1987 | Fette | 381/43 |
| 4,882,758 | 11/1989 | Uekawa et al. | 381/50 |
| 4,979,216 | 12/1990 | Malsheen et al. | 381/51 |
| 5,103,481 | 4/1992 | Iseda et al. | 381/46 |
| 5,175,793 | 12/1992 | Sakamoto et al. | 395/2 |
| 5,181,251 | 1/1993 | Schultleiss et al. | 381/76 |
| 5,195,167 | 3/1993 | Bahl et al. | 395/2 |
| 5,243,656 | 9/1993 | Tanida et al. | 381/90 |
| 5,280,543 | 1/1994 | Yokoyama et al. | 381/76 |

OTHER PUBLICATIONS

Coetzee et al, "An LSP based speech quality measure"; ICASSP–89, pp. 596–599 vol. 1, 23–26 May 1989.

*Primary Examiner*—Robert W. Downs
*Assistant Examiner*—Tariq Hafiz

[57] ABSTRACT

Intelligibility of a human voice projected by a loudspeaker in an environment of high ambient noise is enhanced by amplifying formants (26, 28, 30) of the voice. Because intelligibility of the human voice is derived largely from the pattern of frequency distribution of voice formants, selective enhancement of the formants provides much more readily understandable speech in the presence of high background noise with but minimal increase in amplitude of the speech. Formants are processed by individually selecting them in a spectrum analyzer (42, 124) and individually amplifying (50, 58, 74, 80, 140 through 146) and selectively weighting (56, 57, 78, 82) them before recombining processed formants and unprocessed base band voice components (130) to provide an output signal (116) of greatly improved intelligibility.

25 Claims, 3 Drawing Sheets

PUBLIC ADDRESS INTELLIGIBILITY SYSTEM

This is a continuation of application Ser. No. 676,037, filed Mar. 27, 1991, now abandoned.

BACKGROUND OF THE INVENTION

1. Field of the Invention

The present invention relates to oral communication and more particularly concerns intelligibility of the human voice in the presence of high ambient noise.

2. Description of Related Art

Public address systems are employed in large areas to make announcements or otherwise orally communicate with a large group of people in the same general location. Frequently the area in which the listeners are located is subject to very high background noise, often of such a level that intelligibility of the desired spoken communication from the public address loudspeaker system is greatly degraded. There are many environments of this type where communication is lost or at least partly lost because high ambient noise level masks or distorts the announcer's voice, as it is heard by the listener. These environments include airports, subway, bus and railroad terminals, aircraft and trains, aircraft carriers, landing craft, helicopters, dock facilities and other noisy places. No one who has attempted to understand a public announcement regarding arrival or departure of a plane or train can fail to appreciate the difficulty of extracting useful information in the presence of such background noise.

Attempts to minimize loss of intelligibility in the presence of high background noise have involved use of equalizers, clipping circuits, or simply increasing the volume of the public address announcement. Equalizers and clipping circuits may themselves increase background noise, and thus fail to solve the problem. Increasing overall level of sound or volume of the public address system does not significantly improve intelligibility and often causes other problems such as feedback and listener discomfort.

Despite the widespread and longstanding recognition of the problem, there has been no solution. Effectively, there is no previously known method for significantly improving intelligibility of public communication, such as public address announcements and the like, that are masked by high ambient noise conditions.

Accordingly, it is an object of the present invention to provide for improved intelligibility of voice communication that would otherwise be degraded by background noise.

SUMMARY OF THE INVENTION

In carrying out principles of the present invention in accordance with a preferred embodiment thereof vocal formants are selectively amplified and combined to provide a voice signal of improved intelligibility. Selective enhancement of the formants of both voiced sounds and unvoiced sounds, together with selective weighting and combining of enhanced formants to yield a combined output signal, provides a voice signal of greatly increased intelligibility, even in the presence of very high background noise.

DESCRIPTION OF THE PREFERRED EMBODIMENT

Figure 1:
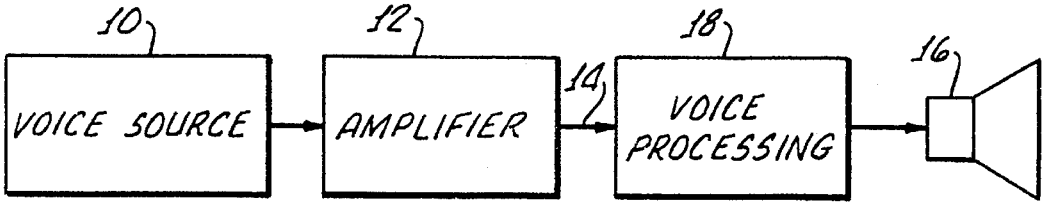
FIG. 1 is a simplified block diagram illustrating connection of a voice processor in a typical loudspeaker or recording system.

FIG. 1 illustrates, in a much simplified form, basic components of a public address system having voice intelligibility processing. A voice source 10, which may be a live microphone or a record player, such as a cassette, disc or the like, bearing a recorded vocal announcement, feeds an electronic voice signal to an amplifying system 12, which provides an output signal on a line 14 that heretofore has been fed directly to a loudspeaker system, generally indicated at 16. Speaker system 16 commonly includes a number of loudspeakers positioned at various locations around an area through which a public address announcement is to be heard. As previously mentioned, such an area usually has a high noise background that significantly degrades intelligibility of the public address announcements. Great care and particular attention are demanded of a listener who would understand all of the words of a public address announcement in an airport terminal, train station, or similar high background noise environment. Even then full recognition of all of the content of the announcement may be lacking, and in some cases the announcement may be almost completely unintelligible.

According to the present invention there is interposed between the system amplifier 12 and the speaker system 16 a voice processor system 18 that causes the voice sound projected by the speaker system 16 to have greatly enhanced intelligibility even in the presence of very high background noise, and without significantly increasing the level of the sound produced by the speaker 16. The system of FIG. 1, with the sole substitution of a recording device for the device illustrated as speaker system 16, may be used to make enhanced intelligibility recordings, either to be played back in a noisy environment or to record voices spoken initially in a noisy environment. Such systems will be described more particularly below.

Voice processor 18 is an active self-adaptive system that takes advantage of the manner in which human speech is generated, heard and processed by the individual human ear and brain. Briefly, processing system 18 identifies vocal formants of vowels, consonants, fricatives and plosives, selectively amplifies and weights them, and combines them to provide a voice signal of greatly increased intelligibility.

A brief description of mechanics of speech generation and comprehension will help to understand operation of the present invention. Human speech is produced by generating sounds in the vocal tract, which causes these sounds to resonate at different frequencies. Vowels are generated by an air stream expelled from the lungs to cause vibration of the human vocal folds, generally known as vocal cords. Sound generated by vibration of the vocal cords is composed of a fundamental frequency or base band and many harmonic partials or overtones, at successively higher frequencies. Amplitudes of the harmonics decrease with increasing frequency at a rate of about 12 decibels per octave. The base band or fundamental frequency and its overtones pass through the vocal tract, which includes various cavities within the throat, head and mouth that provide a plurality of individual resonances. The vocal tract has a plurality of characteristic modes of resonance and to some extent acts as a plurality of resonators operating on the base band or fundamental frequency and its overtones. Because of the selective resonating action of the vocal tract, amplitudes of the several partials of the fundamental frequency of the vocal cords do not decrease in a smooth curve with increasing frequency, but exhibit sharp peaks at frequencies corresponding to the particular resonances of the vocal tract. These peaks or resonances are termed "formants".

Figure 2:
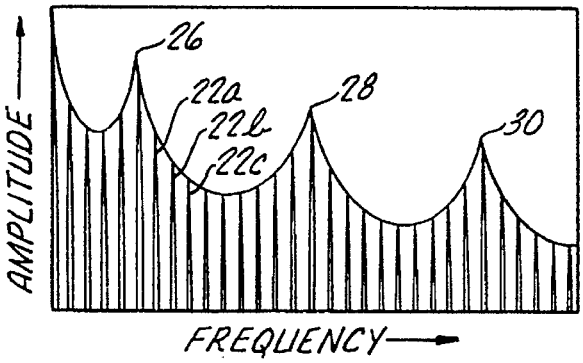
FIG. 2 is a graph depicting certain typical formants present in human speech.

FIG. 2 illustrates a graph of a voiced sound (e.g. a vowel), plotting amplitude against frequency of a number of harmonics. At the left side of the graph, at the lowest frequency, is the fundamental frequency or base band caused by vibration of the vocal cords. This base band frequency is between about 60 and 250 hertz for a typical adult male voice. The many harmonics of the fundamental frequency are indicated by the individual components, such as 22*a*, 22*b*, 22*c*, etc. It can be seen that the entire voice signal is made up of the base band and a large number of individual harmonics over the entire frequency band. The frequency band of interest in voice signals is generally between 60 and about 7,500 hertz. FIG. 2 illustrates the fact that the individual harmonics, which have amplitudes that naturally decrease with increasing frequency, do not decrease in amplitude in a smooth curve, but rather exhibit certain peaks, such as those indicated at 26, 28, and 30. These peaks represent the individual resonances of the vocal tract and are illustrated for purposes of exposition as being three in number, although there may be as many as four, five or more in an ordinary human vocal tract. These peaks, or vocal tract resonances, are the formants of the spoken voice. In an adult male the first four (lower frequency) formants are close to about 500, 1500, 2500 and 3500 hertz, respectively. Moving the various articulatory organs (including the jaw, the body of the tongue, the tip of the tongue) changes frequency of the several formants over a wide range. Different formant frequencies have different sensitivities to shape or position of individual articulatory organs. It is selected movement of these organs that each human speaker employs to give voice to a selected vowel. Conversely, when listening to spoken words each vowel can be recognized by its unique set of formants.

The discussion given above with respect to voiced sounds and the formants of FIG. 2 is equally applicable to unvoiced sounds, which also have formants caused by resonant cavities of the vocal tract. Voiced sounds are those caused by vibration of the vocal cords in the air stream generated by the lungs and comprise the vowels of the spoken word. Unvoiced sounds are those that are generated by the vocal tract in the absence of vibration of the vocal cords. Unvoiced sounds include consonants, plosives and fricatives. These sounds are those which are generated by action of the tongue, teeth and mouth, which control the release of air from the lungs, but without vibration of the vocal cords. These include sounds of various consonants. Unvoiced sounds include sounds of spoken words involving the letters M, N, L, Z, G (as in frigid), DG (as in judge), etc. These plosives, fricatives and consonants, although not involving vocal cord vibration, nevertheless have characteristic frequencies, generally higher than the fundamental frequency of vocal cord vibration, and often in the range of 2,000 to 3,000 hertz. However, regardless of whether sound produced in the vocal tract is generated by vibration of the vocal cords (voiced sounds), or is generated without vibration of the vocal cords (consonants, plosives, and fricatives), the vocal tract resonances operate to produce formants which are resonant peaks in different ones of the harmonics of the generated fundamental frequency.

It has been found that the formants in the human speech make a major contribution to intelligibility of speech to the listener. That is, the human listener will recognize specific vowels or consonants, plosives or fricatives by the particular pattern of its formants. This is the pattern of relative frequencies of the several formants. The formant pattern may be based upon fundamental frequencies of higher or lower pitch, such as the higher pitch of the voice of woman or child, or the lower pitch of the voice of a man. Nevertheless, the pattern of formants, the relative frequencies of resonant peaks identifies to the listener the nature of the spoken sound. A discussion of acoustics of the human voice may be found in the article entitled "The Acoustics of the Singing Voice" by J. Sunberg in *Readings from Scientific American, The Physics of Music*, with an introduction by C. Hutchins, published by W. H. Freeman and Company in 1948.

Intelligibility of sound to the human ear is described in part in the "Handbook For Sound Engineers—The New Audio Cyclopedia" edited by Glen Ballou, published by Howard W. Sams and Company in 1987. Page 162 of this handbook contains a description of findings that different frequencies contained in the spoken voice contribute different amounts to intelligibility of the spoken word. Thus, mid-band frequencies, in the order of about 1.5 to 3.5 kilohertz, contribute larger percentages to intelligibility. For example, broken down by octaves in the frequency range of about 250 hertz to 5 Kilohertz and above, the octave centered at 250 hertz contributes 7.2% to intelligibility of the spoken voice heard by a human listener, the octave centered at 500 hertz contributes 14.4%, and that centered at 1 kilohertz contributes 22.2%. The octave centered at 2 kilohertz contributes a maximum of 32.8%, and the octave centered at 4 kilohertz contributes 23.4%.

The present invention employs knowledge of the manner in which speech is generated and the manner in which the various voiced and unvoiced sounds are formed and also uses a unique weighting of selectively amplified speech formants to provide an overall speech signal that has an intelligibility that is greatly enhanced, even in the presence of high background noise. Fundamentally, according to embodiments disclosed herein, voice intelligibility is enhanced by selectively amplifying speech formants and combining the enhanced formants.

Figure 3:
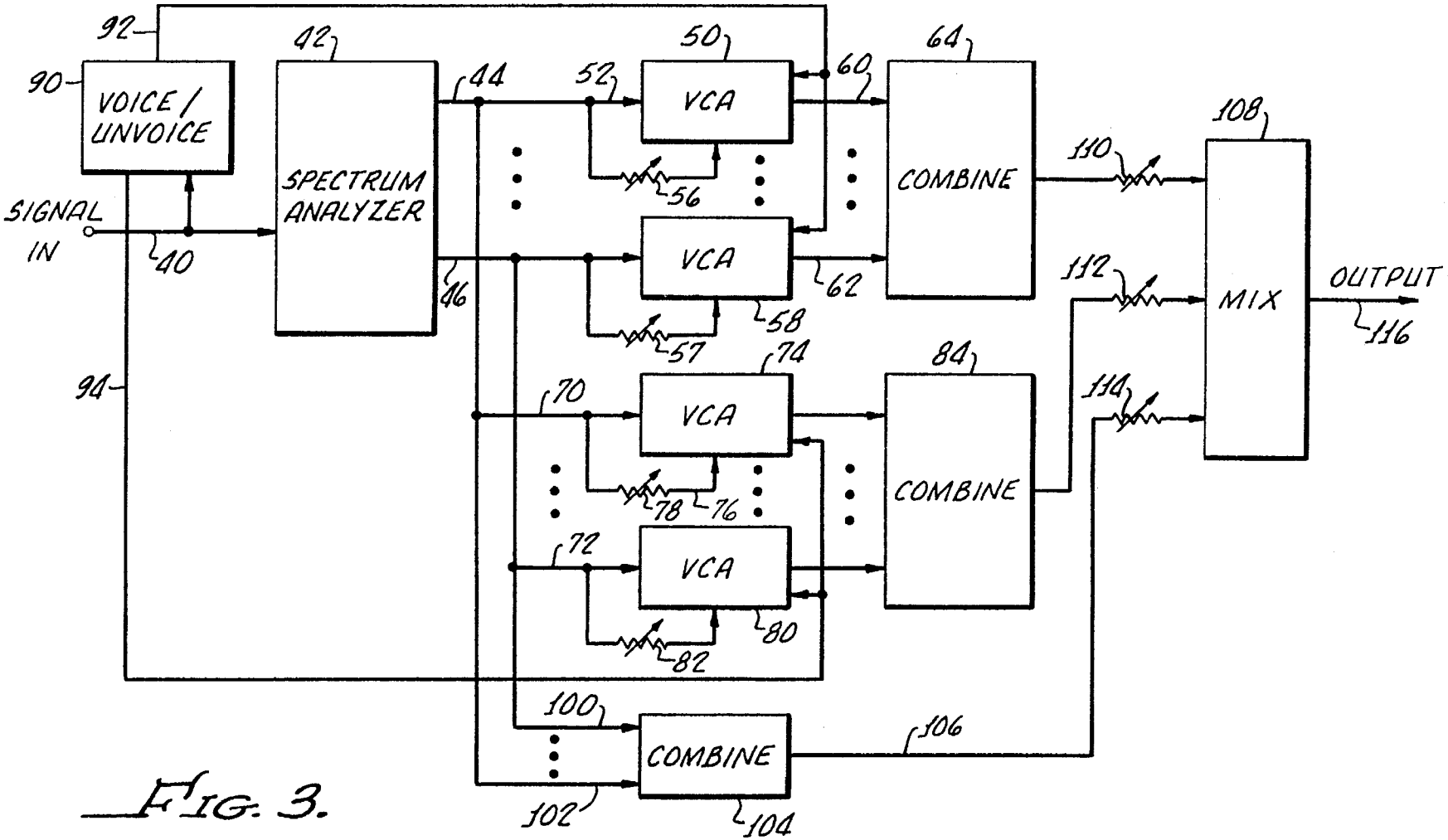
FIG. 3 is a block diagram of one processing system for enhancing speech intelligibility.

Illustrated in FIG. 3 is a block diagram of one embodiment of the present invention. An input electrical signal on a line 40, which may be derived from a microphone or record playing medium or similar sound source, is fed to a spectrum analyzer 42 that breaks the incoming signal down into a number, such as 30 for example, of different frequency components which appear on separate output lines or frequency channels indicated at 44 and 46. It will be understood that lines 44 and 46 represent 30 different output lines, each at a different narrow band of frequencies, from the output of the spectrum analyzer. Processing of the signal in each individual frequency channel is identical to processing the signal in each of the others in this arrangement so that a description of processing of the signal in channel 44 of the spectrum analyzer output will suffice to describe processing in each of the other channels. The signal in channel 44 is fed to the signal input of a voltage controlled amplifier (VCA) 50, having a signal input on line 52 and a gain controlling input on line 54. The gain controlling input on line 54 is derived from the input line 52 via an adjustable resistor 56. The group of thirty channels 44 through 46 and their voltage controlled amplifiers 50 through 58 have outputs on lines 60 and 62 (representing 30 individual lines) which are combined in a summing network 64. Channels 44 through 46 handle voiced signals or vowel sounds.

Spectrum analyzer output signals in the same 30 channels are also fed to consonant and fricative channels 70 through 72, it being understood, again, that there may be 30 or more of these channels, spaced in ⅓ octave increments, each being identical to the other, except for frequency. However, in the case of the consonant and fricative channels, a fewer number, such as 5 or 10 channels, may be adequate. The consonant and fricative channels 70 through 72 are similar to the vowel (voiced) channels 44 through 46, and each includes a voltage controlled amplifier, such as amplifier 74 for channel 70, having the signal in channel 70 as its input, and having a voltage control input 76 provided from its input via an adjustable resistor 78. So, too, channel 72 includes a voltage controlled amplifier 80, having a control input from its signal input via an adjustable resistor 82. As with the voiced channels, the outputs of the consonant and fricative channels are combined in a combining circuit 84.

Input signal 40 also is fed to a voiced/unvoiced switch 90 which provides selection signals on output lines 92,94 indicating whether or not a voiced signal exists. The voiced/unvoiced signal selector switch may simply comprise a low pass filter that passes a frequency of 300 hertz or below. In other words, this switch selectively passes the fundamental frequency of a vowel. In general the fundamental frequency of the spoken vowel (the voiced sounds) is between about 60 and 250 hertz, so that if a signal in this low pass band exists, it is known that a voiced signal exists, whereas if there is no output from the low pass filter it is known that the input signal comprises only unvoiced sounds. In the presence of a voiced signal, line 92 provides a control signal that turns on the voltage controlled amplifiers 50 and 58 of the voiced channels, whereas a signal on line 94 in the presence of a voiced signal turns off the voltage controlled amplifiers 74,80 of the unvoiced channels. Alternatively, in the absence of a voiced component (e.g. no vowel sound), the signal on line 92 turns off the voiced channel amplifiers 50 through 58 and the signal on line 94 turns on the unvoiced channel amplifiers 74 through 80.

It is desired to combine the voiced and unvoiced sounds, after processing, with the original unprocessed sound, and, in particular, with the base band or fundamental frequency of the voice. However, since the spectrum analyzer and its several filters introduce some degree of phase shift into its output signals, the unprocessed voice signal to be combined with the processed voiced and unvoiced signals is derived from the outputs of the spectrum analyzer, so that the combined signal is subject to the same phase shifts. To this end signals from all of the spectrum analyzer output lines, channels 44 through 46 inclusive, are fed via lines 100 and 102 to a summing or combining network 104 which provides on its output line 106 a reconstituted combined voice signal having all of the phase shifts imposed by the spectrum analyzer, which thus may be properly combined in a mixer 108 with the combined voiced signals from combiner 64 and the combined unvoiced signals from combiner 84, via level adjusting potentiometers 110,112 and 114. The output of mixer 108 on line 116 provides the enhanced intelligibility voice signal.

To properly weight the several components of the signals in the several channels 44 through 46 and 70 through 72, according to respective contributions to intelligibility, the variable resistors 56,57,78 and 82 at the control inputs of the voltage controlling amplifiers are employed to weight amplification of the several components of the output of the spectrum analyzer.

Table 1 below indicates percentage contribution to intelligibility of different frequency components of human voice signals that is broken down into one-third octave frequency bands or full octave frequency bands. Voltage control adjustment resistors 56, 57, 78, 82, etc. are adjusted according to this table. Those formants in frequency bands that contribute more to intelligibility, according to Table 1, are amplified to a proportionately greater degree. For example, with a one octave band for the spectrum analyzer, that channel centered at 2 kHz has its gain control resistor adjusted to provide a gain control signal of a relative value of 32.8, whereas the channel centered at 500 hertz has its gain control resistor adjusted to provide a gain control signal of a relative value of 14.4, etc.

TABLE 1

| Band Center Frequency Hz | % Contribution One-Third Octave | % Contribution Octave |
|---|---|---|
| 200 and below | 1.2 | |
| 250 | 3.0 | 7.2 |
| 315 | 3.0 | |
| 400 | 4.2 | |
| 500 | 4.2 | 14.4 |
| 680 | 6.0 | |
| 800 | 6.0 | |
| 1 kHz | 7.2 | 22.2 |
| 1.25 kHz | 9.0 | |
| 1.6 kHz | 11.2 | |
| 2 kHz | 11.4 | 32.8 |
| 2.5 kHz | 10.2 | |
| 3.15 kHz | 10.2 | |
| 4 kHz | 7.2 | 23.4 |
| 5 kHz and above | 6.0 | |

Effectively, the system illustrated in FIG. 3 automatically selects each individual voice formant by its amplitude. As can be seen in FIG. 2, formants have increased amplitudes because of the resonant peaks of the vocal tract, and thus the several voltage controlled amplifiers in each of the channels will select a highest amplitude frequency component in the individual frequency band and increase its amplitude by the illustrated square law amplification (the amplifier input is used to control its gain). If the amplitude of the input to the individual voltage controlled amplifier is below a predetermined level, the signal level is decreased by the amplifier rather than amplified. Therefore, for those frequency bands at the output of the spectrum analyzer that include a formant of relatively higher amplitude, such formant is amplified by the individual voltage controlled amplifier of which the gain is controlled by the input signal itself, as adjusted by the weighting potentiometer 56 or 57. The same operation occurs with respect to the consonants and fricatives in channels 70 through 72. Basically the system selectively identifies formants in the speech, amplifies these formants in a square law type amplification, and then, after selective weighting of amplification (e.g. gain) of the formants, combines the formants with the original signal to provide an intelligibility enhanced output.

Figure 4:
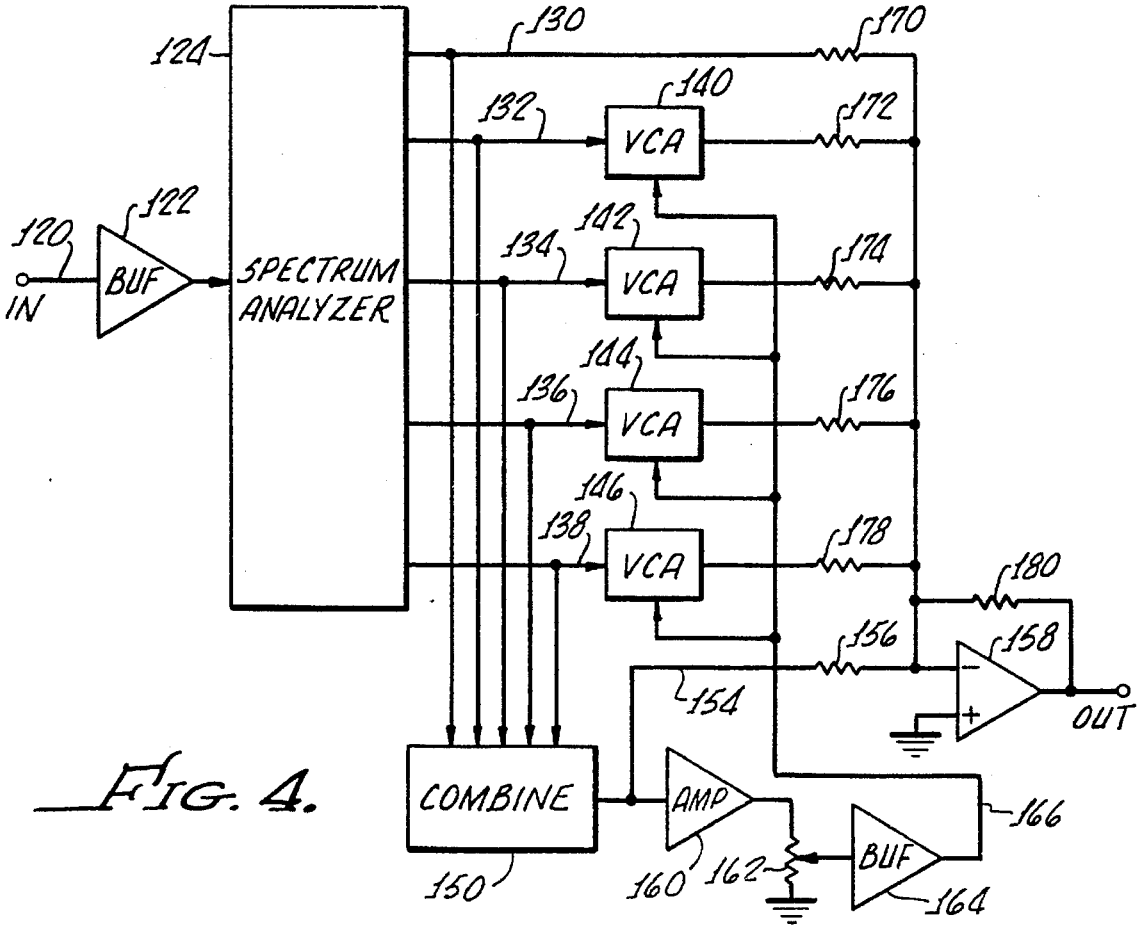
FIG. 4 is a block diagram of a modified form of processing system for speech intelligibility enhancement.

Illustrated in FIG. 4 is a modified and simplified version of the processor of FIG. 3. This processor, like that of FIG. 3, will define the processor 18 of FIG. 1 when incorporated in a standard public address or recording system.

In the system of FIG. 4 the signal is not separated into voiced and unvoiced components, nor is each voltage controlled amplifier controlled by its own input. Thus the arrangement is greatly simplified and yet provides equal or improved performance. In the arrangement of FIG. 4, moreover, no predetermined or pre-computed and generalized weighting of individual formant amplification is employed. Rather a simple calibration procedure is followed to effectively bring the level of each formant up to the level of the base band signal.

An input voice signal on line 120 of FIG. 4 is fed through a buffer amplifier 122 to a spectrum analyzer 124, which may have any desired number of channels. The spectrum analyzer may be divided into octaves or one-third octaves or similar divisions. In a typical system, as will be described more particularly below, the spectrum analyzer is provided with 30 separate channels to provide 30 different output frequency bands of successively higher frequencies, each adjoining a neighboring band. A lowermost output band of the spectrum analyzer is provided on a line 130 and comprises all those signal components in the lower frequency band, below about 300 hertz. This is the base band or fundamental frequency range of the vocal cords. A plurality of additional bands (which may actually be 29 in number) are indicated at 132,134,136 and 138. Each of these feeds its own individual voltage controlled amplifier 140,142,144 and 146. All of the signals at all of the outputs of the spectrum analyzer are fed as inputs to a mixing or combining network 150 from the output of which appears a combined signal on a line 154 that is fed via a summing resistor 156 to the inverting input of an operational amplifier 158, which has its non-inverting input grounded, and which is used as a summing amplifier.

The output of combining network 150 is also fed to an amplifier 160 and thence via an adjusting potentiometer 162, to a buffer amplifier 164. The output of buffer amplifier 164 provides a common gain control input on line 166 to each of the voltage controlled amplifiers 140 through 146 etc. of the several channels of the processor. The control signal on line 166 at buffer amplifier 144 is adjusted in magnitude individually (as will be described below) at each voltage controlled amplifier to provide the above-described weighting. Thus each of voltage controlled amplifiers 140 through 146 includes an adjustable potentiometer (not shown in FIG. 4) which is set to provide an appropriate weighting of the individual channel. This weighting is accomplished on an empirical basis by initially disconnecting all channels of the spectrum analyzer, excepting only the base band and the one channel being adjusted. Then the amplitudes of the base band signal and that at the output of the voltage controlled amplifier (VCA 140 for example) are compared. The potentiometer that varies the amount of control signal fed to this VCA is then adjusted, to adjust the amplifier gain control, so as to bring the amplitude of the output of the individual VCA being adjusted up to the level of the amplitude of the signal in the base band channel. Having adjusted one channel, this channel is turned off and the next channel, uniquely, is turned on. The output from its voltage controlled amplifier is then compared to and adjusted to be equal to the amplitude of the base band. This procedure is followed in sequence with each of the spectrum analyzer channels individually until all channels of the analyzer have been individually adjusted, with the amplitudes of the outputs of each of the VCA's thus being individually brought up to the amplitude of the signal in the base band channel. Thus adjustment is performed with a calibration signal at input 120 in the form of any suitable voice or simulated voice signal. The test signal may comprise a signal representing the base band signal with all of its harmonics, but free of the resonant peaks that comprise the formants.

Amplifier 160 may have a gain of about +5, which is effectively attenuated by adjustment of potentiometer 162. Buffer amplifier 164 has a unity gain. The summing network, by which the inputs of all the channels are summed at the inverting input of operational amplifier 158, including summing resistors 170, 172, 174, 176, 178 and 156, is made to sum all of the inputs equally at the input of the amplifier. Thus the feedback resistor 180 of operational amplifier 158 is equal to each of the summing resistors 170 through 178 and 156, which are all equal to one another.

It will be seen that in the embodiment of FIG. 4 all of the formants, whether derived from voiced or unvoiced sounds, are processed in the same manner and with similar empirically determined weighting. Each of the formants is individually selected and enhanced since the individual voltage controlled amplifiers operate solely upon the highest amplitude components within the individual frequency bands at the output of the spectrum analyzer and then only if the signal outputs are above a predetermined threshold. The several VCA's effectively discard those signals below this threshold and selectively amplify the higher amplitudes. Effectively the several voltage controlled amplifiers are controlled by the base band signal itself. Although the base band signal is combined with the other and higher frequencies, which are the harmonics of the base band, the latter is of significantly greater amplitude than its harmonics, and higher amplitude than the consonants, fricatives and plosives, and thus provides the greatest component of the control signal on line 166 that is fed to all of the control inputs of the individual voltage controlled amplifiers. Thus in the arrangement of FIG. 4 the several formants are effectively amplified under control of the base band signal, whereas in the arrangement of FIG. 3 each individual formant is effectively amplified under control of itself.

Figures 5, 6:
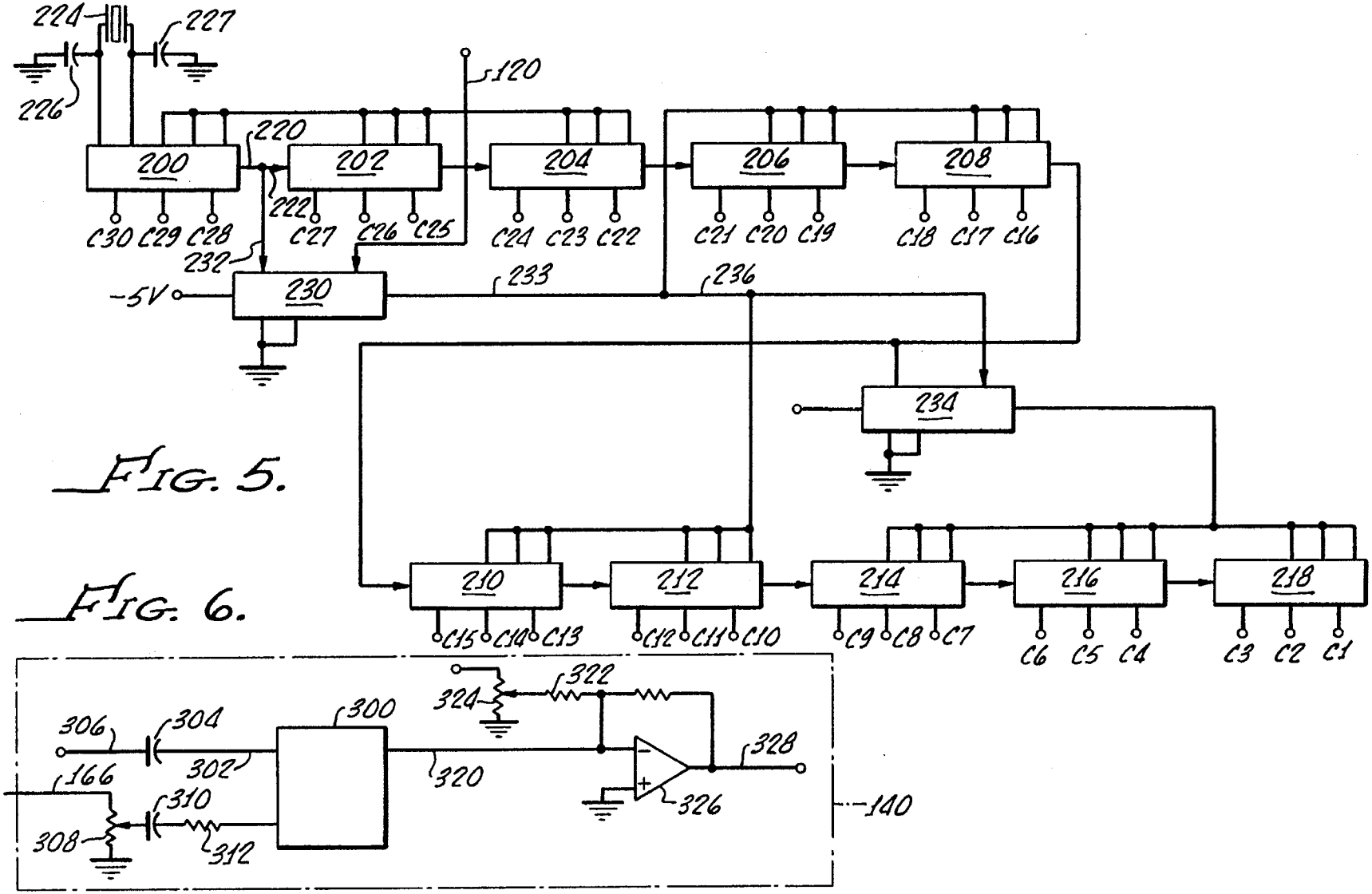
FIG. 5 is a block diagram of a spectrum analyzer useful with the system of FIG. 4.
FIG. 6 illustrates a typical voltage controlled amplifier for use in the processing system of FIG. 4.

Illustrated in FIG. 5 is an exemplary spectrum analyzer based upon interconnection of a plurality of National Semiconductor counter or divider chips Model 120 TPQ. Thus each of ten different chips 200, 202, 204, 206, 208, 210, 212, 214, 216, and 218 are interconnected as shown in FIG. 5, with the output on line 220 of chip 200 being connected to the input on line 222 of the next chip 222 in the sequence, etc. All of the chips are connected in the same manner, excepting only that the first in the sequence, chip 200, is provided with a frequency reference in the form of a 1 megahertz crystal 224 connected to ground through capacitors 226 and 227. The output of each chip provides the input frequency reference for the next chip in the series, excepting that a switched capacitive filter chip 230, having a clock input on a line 232 from the output of chip 200, provides a filter that separates higher signal frequencies from the clock frequency. The clock output of filter 230 on line 233 is fed to the inputs of chips 210 and 212 and to the input of a second switched capacitive filter 234 via a line 236. Filter 234 has outputs connected to control the inputs to chips 214, 216 and 218. The filter chip 230 controls the inputs to chips 210 and 212 and chips 206 ad 208. The input from line 120 of FIG. 4 is provided directly to chips 200, 202 and 204, and to the switched capacitor filter chip 230. The thirty different frequency outputs of this spectrum analyzer appear on the 30 lines labeled C1 through C30, inclusive, with C30 being the highest frequency channel and C1 being the lowest frequency. For example, outputs C1, C2 and C3 may have frequencies of approximately 20, 32 and 40 hertz, respectively, whereas the highest frequency on channel C30 may have an output frequency of about 20 kilohertz. The system uses only ⅓ octave frequencies between 60 and 8,000 hertz. The chip 200 has a built in oscillator of which the frequency is controlled by the crystal 224 and capacitor 226. Frequency is divided down through the several chips to obtain the 30 different frequencies previously mentioned. The switched filters 230, 234 may be National Semiconductor chip "LMF, 60–100".

Illustrated in FIG. 6 is an exemplary one of the voltage controlled amplifiers (VCA's), which are identical for all channels of the processor of FIG. 4. Each voltage controlled amplifier chip 300 is primarily a Signetics NE/SA 572 "Programmed Analog Compandor", which is a dual channel, high performance gain control circuit, with modified input and output circuitry shown in FIG. 6. VCA chip 300 has an input on a line 302 via a capacitor 304 from a line 306 (corresponding to lines 132, 134, 136, 138) of the spectrum analyzer 124 (FIG. 4). The voltage control input for this amplifier, which is provided at the output of buffer 164 on line 166 (FIG. 4), is fed through a calibrating and weighting potentiometer 308 (corresponding to potentiometers 56, 57, 78, 82 of FIG. 3) and thence from the potentiometer wiper arm via a capacitor 170 and an input resistor 172 to the control input of the gain controlling VCA chip 300. The voltage control amplifier output to the summing network 172, 174, 176, 178, 156 (FIG. 4) is provided from an output terminal 320, which is biased via a fixed resistor 322 and a voltage adjusting potentiometer 324 from a fixed voltage source. The voltage control amplifier output is fed to the inverting input of an operational amplifier 326, having its non-inverting input grounded to provide on a line 328 the output to the summing network 170 through 178 and 156 of FIG. 4. It is the potentiometer 308 that controls the individual weighting of the individual voltage controlled amplifier. This is the resistor that is adjusted on a channel by channel basis to bring the amplitude of each channel individually up to the amplitude of the base band signal. Of course, once having determined the appropriate magnitude of the resistance of potentiometer 308, the latter may be provided as a fixed resistor, which may be capable of being trimmed by a small amount.

As described above, FIG. 1 illustrates use of voice processing methods and apparatus of the present invention applied in real time to a voice communication system. It will be readily appreciated that the same voice processing can be applied to the making of any suitable record, which is later and repetitively employed as the sound input to a conventional public address system. In making such a record, using the voice processing and intelligibility enhancement techniques described herein, the resulting record inherently includes the intelligibility enhancement provided by the processing circuitry. Therefore, no further intelligibility enhancement processing is needed when such a record is played through a conventional public address or other loudspeaker system.

To make such a record there is used a system substantially the same as that shown in FIG. 1. The only difference is that there is substituted for speaker 16 a recording device, such as a tape recorder or the like, so that the sound recorded on the tape or other record medium includes the enhanced and combined formants, processed by circuitry 18, just as previously described.

Where the element identified as speaker 16 in the arrangement of FIG. 1 is actually a recording device, instead of a speaker system, so that an intelligibility enhanced record may be. made by such a recording device, the input signal from source 10 may be a clear and clean voice signal, such as, for example, a signal spoken in a sound studio or other environment free of background noise. However, the described processing will also provide an intelligibility enhanced recording where the input sound comprises a spoken voice that originates in a noisy background environment. Such a condition exists in many situations, such as, for example, in the case of a cockpit voice recorder (CVR), which is a recording device carried in the cockpit of commercial aircraft for the purpose of making a record of occurrences and conversations of the personnel in the aircraft cockpit. The cockpit environment is exceedingly noisy, so that, in the past, recordings made by the cockpit voice recorder have been difficult to comprehend because of their degraded intelligibility. The present invention is applicable to such a cockpit voice recorder to enhance intelligibility of the recorded sound when played back on conventional playback equipment. An intelligibility enhanced cockpit voice recorder of the present invention is substantially the same as the system illustrated in FIG. 1, wherein source 10 comprises a microphone employed to collected sound for recording in a known voice recorder (which is substituted for speaker 16 of FIG. 1). The output of microphone 10 (the voice source) is fed to a suitable amplifier, such as amplifier 12. The output of the amplifier is fed to the intelligibility enhancing voice processing circuit 14, as previously described. Circuit 14 selectively identifies and amplifies formants of the voice signal even though the latter exists initially in the presence of a relatively high level of background noise. Therefore the formant processing, as described above, will result in a recording of enhanced intelligibility, even though the recording also contains the recorded noise.

What is claimed is:

1. A method for enhancing intelligibility of spoken words projected into an area of ambient noise from a loudspeaker system that receives an input signal derived from an electrical voice signal representing spoken words having formants, said method comprising the steps of:

generating an electrical voice signal that represents spoken words having formants, amplifying individual ones of said formants of said spoken words by controlled amounts, weighting the amount of amplification of different ones of said formants by mutually different weighting values, combining said amplified weighted formants of said spoken word to generate an enhanced voice signal representing said spoken words, and feeding said enhanced voice signal to a loudspeaker system to be projected as sound into an area of ambient noise.

2. The method of claim 1 wherein said voice signal includes a base band signal having an amplitude, and wherein said step of amplifying individual ones of said formants comprises the step of raising amplitude of said formants to the amplitude of said base band component.

3. The method of claim 1 wherein said step of weighting said formants comprises weighting said formants by greater amounts between frequencies of about 1 kilohertz and 4 kilohertz and by lesser amounts at frequencies below about 1 kilohertz and above about 4 kilohertz.

4. The method of claim 3 wherein said step of weighting comprises weighting said formants by greater amounts at a frequency in the range of about 2 to 3 kilohertz.

5. The method of claim 1 wherein said step of weighting comprises increasing the amplitude of each of a group of said formants to a predetermined level.

6. The method of claim 1 wherein said step of amplifying formants comprises the step of controlling the level of each formant in accordance with its own amplitude.

7. The method of claim 1 wherein said step of amplifying individual ones of said formants comprises generating a control signal representative of the level of said voice signal and individually amplifying said formants in accordance with the magnitude of said control signal.

8. The method of claim 1 including the step of combining said formats in predetermined frequency bands to generate an amplification control signal, and wherein said step of weighting comprises amplifying individual ones of said formats in accordance with individually weighted magnitudes of said control signal.

9. A method for enhancing intelligibility of a voice to be projected into an area of ambient noise from a loudspeaker system that receives an input signal derived from an electrical voice signal having formants, said method comprising the steps of:

amplifying individual ones of said formants by controlled amounts, weighting the amount of amplification of said formants by different weighting values, combining said amplified weighted formants to generate an enhanced voice signal, and feeding said enhanced voice signal to a loudspeaker system to be projected as sound into an area of ambient noise, said formants including a base band signal, and including the step of phase shifting said formants and base band signal before said step of combining, wherein said voice signal includes vowels, consonants and fricatives, and wherein said step of amplifying comprises enhancing formants of said vowels, consonants and fricatives, and combining said enhanced formants with said base band signal.

10. A method for enhancing intelligibility of a voice to be projected into an area of ambient noise from a loudspeaker system that receives an input signal derived from an electrical voice signal having formants, said method comprising the steps of:

amplifying individual ones of said formants by controlled amounts, weighting the amount of amplification of said formants by different weighting values, combining formants in predetermined frequency bands to provide an amplification control signal, said step of weighting comprising amplifying individual ones of said formants in accordance with individually weighted magnitudes of said amplification control signal, combining said amplified formants with said amplification control signal to provide an enhanced output signal, and feeding said enhanced output signal to a loudspeaker system to be protected as sound into an area of ambient noise.

11. A method for enhancing intelligibility of spoken words projected as the output of a loudspeaker that projects sound into an area of ambient noise, said method comprising:

means for inputting an electrical voice signal representing a sequence of spoken words including a base band component and a plurality of formant components of said sequence of spoken words, separating said electrical voice signal into a plurality of individual frequency components of different frequencies, including a base band frequency, and a plurality of higher frequencies, amplifying a plurality of said individual frequency components, generating an amplification control signal from at least one of said individual frequency components, employing said amplification control signal to individually weight the amount of said amplification of individual frequency components by different weighting values to generate weighted signals, combining said weighted signals to generate an enhanced voice signal that represents said sequence of spoken words, and feeding said enhanced voice signal to a loudspeaker to be projected as sound into an area of ambient noise.

12. A method for enhancing intelligibility of voice sound projected as the output of a loudspeaker that projects sound into an area of ambient noise, wherein said loudspeaker is supplied with an input signal derived from an electrical voice signal representing a voice including a base band component and a plurality of formant components, said method comprising the steps of:

separating said electrical voice signal into a plurality of individual frequency components of different frequencies, including a base band frequency, and a plurality of higher frequencies, amplifying a plurality of said individual frequency components, generating an amplification control signal from at least one of said individual frequency components, employing said amplification control signal to individually weight the amount of said amplification of individual frequency components by different weighting values to generate weighted signals, combining said weighted signals to generate an enhanced voice signal, feeding said enhanced voice signal to a loudspeaker to be projected as sound into an area of ambient noise, and said steps of amplifying frequency components and employing said amplification control signal comprising the steps of amplifying at least one of said individual frequency components by an amount dependent upon its own magnitude.

13. Voice intelligibility enhancement apparatus for enhancing intelligibility of an electrical voice signal comprising:

means responsive to said electrical voice signal for generating frequency band signals in a plurality of different frequency channels covering a preselected frequency range, one of said frequency band signals comprising a base band signal, amplifier means in each of a group of said frequency channels for amplifying frequency band signals in each channel of said group to generate a plurality of amplified frequency band signals, each said amplifier means having an amplification control input, means responsive to at least one of said frequency band signals for generating an amplification control signal, means for applying said amplification control signal to a plurality of said amplification control inputs, means for combining said amplified frequency band signals with said base band signal to generate an enhanced signal output, said base band signal having a base band signal amplitude, and wherein said signals in each of a group of different ones of said channels each includes a formant signal having an amplitude representing a formant of said electrical voice signal, said formant amplitudes decreasing with increasing frequency, and including means in said amplifier means for increasing the amplitude of each of said formant signals to an amplitude substantially equal to the amplitude of said base band signal, whereby the amplitude of each formant signal is brought up to the amplitude of said base band signal, and loudspeaker means responsive to said enhanced signal output for projecting said enhanced signal output into an area of ambient noise.

14. A voice intelligibility enhancement system comprising:

input means for receiving and inputting an electrical voice signal that represents a sequence of complete spoken words having formants, a spectrum analyzer connected to receive said electrical voice signal and having individual frequency band signals in a plurality of individual frequency band output channels of mutually different frequency bands, a plurality of voltage controlled amplifiers each located in an individual one of said channels, each having an input from one of said channels and having a gain control input, control generating means responsive to signals in at least one of said channels for feeding gain control signals to the gain control input of a plurality of said amplifiers, said amplifiers and control generating means including weighting means for weighting said gain control signals by different weighting values, a combining circuit having an input from each of a plurality of said frequency band channels and having a combined output, output means for generating an enhanced voice signal output that represents said sequence of complete spoken words, said output means comprising means for combining outputs of said amplifiers and said combined output, and loudspeaker means responsive to said enhanced signal output for projecting said enhanced voice signal output into an area of ambient noise.

15. The system of claim 14 wherein said control generating means comprises means responsive to the signal in one of said channels for feeding a gain control signal to the gain control input of the amplifier in said one channel.

16. The system of claim 14 wherein said control generating means comprises means responsive to said combined output for feeding a gain control signal to the gain control inputs of a plurality of said amplifiers.

17. The system of claim 14 wherein said means for combining said combined output and said outputs of said amplifiers includes means for combining the signal provided from said spectrum analyzer in a lowest frequency one of said channels with said outputs of said amplifiers and said combined signal to generate said enhanced output.

18. The system of claim 17 wherein said weighting means comprises control level adjust means for adjusting the amount of amplification of each of said voltage controlled amplifiers so as to change the level of the output of the individual amplifier to a level the same as the level of the signal in said lowest frequency channel.

19. The system of claim 14 wherein one of said frequency band channels is a base band channel for passing a band of low frequencies substantially equal to but not greater than the natural frequency of human vocal cords.

20. The system of claim 14 wherein one of said channels passes a band of frequencies not greater than about 300 hertz.

21. Apparatus for improving intelligibility of spoken words represented by an electrical voice signal comprising:

means for inputting an electrical voice signal representing a sequence of complete spoken words having formants, means for selecting components of said electrical voice signal containing formants of said complete spoken words, means for amplifying said selected components according to the magnitude of the respective components, means for weighting the amplification of said selected components with mutually different weighting values, output means for generating an output signal representing said sequence of complete spoken words, said output means including means for combining said amplified and weighted components to generate said output signal representing said sequence of complete spoken words and having amplified formants of said spoken words.

22. The apparatus of claim 21 wherein said means for weighting comprises means for weighting said selected components according to the respective contributions of each to intelligibility of a human voice signal.

23. The apparatus of claim 21 wherein said means for amplifying comprises a square law amplifier having both a signal input and a gain control input from an individual component of said electrical voice signal.

24. The apparatus of claim 21 including means for combining said amplified and weighted components to generate a control signal, and wherein said means for amplifying comprises a voltage controlled amplifier for each component having a signal input from an individual one of said components of said electrical voice signal, and a gain control input from said control signal.

25. The apparatus of claim 48 wherein said means for weighting comprises means for relatively adjusting the gain control input of said voltage controlled amplifiers.

* * * * *